United States Patent [19]

Ballard

[11] Patent Number: 4,610,916

[45] Date of Patent: Sep. 9, 1986

[54] MONOFILAMENTS, AND FABRICS THEREOF

[75] Inventor: Larry Ballard, Columbia, S.C.

[73] Assignee: Shakespeare Company, Columbia, S.C.

[21] Appl. No.: 793,580

[22] Filed: Oct. 31, 1985

[51] Int. Cl.[4] ..... D03D 3/00

[52] U.S. Cl. ..... 428/224; 162/DIG. 1; 162/358; 428/225; 428/229; 428/364; 428/365; 428/392; 428/421; 525/189

[58] Field of Search ..... 525/189; 428/224, 225, 428/229, 421, 422, 364, 365, 392; 162/DIG. 1, 358

[56] References Cited

U.S. PATENT DOCUMENTS

| | | | |
|---|---|---|---|
| 4,025,582 | 5/1977 | Needheim | 525/189 |
| 4,421,588 | 12/1983 | Davies | 156/308 |
| 4,454,189 | 6/1984 | Fukata | 428/364 |
| 4,455,410 | 6/1984 | Giles, Jr. | 525/436 |
| 4,493,917 | 1/1985 | Bailleux et al. | 524/394 |
| 4,544,700 | 10/1985 | Wright | 525/189 |

FOREIGN PATENT DOCUMENTS

| | | | |
|---|---|---|---|
| 0154757 | 9/1983 | Japan | 525/189 |

*Primary Examiner*—James J. Bell

*Attorney, Agent, or Firm*—Renner, Kenner, Greive, Bobak & Taylor

[57] ABSTRACT

A blend of two resins forming a novel monofilament comprises from about 50 to 95 parts by weight of a linear polyphenylene sulfide and, from about 5 to 50 parts by weight of a melt extrudable copolymer consisting essentially of an olefin and a halogenated monomer. The monofilament is prepared by extruding a mixture of the linear poly phenylene sulfide and the melt extrudable copolymer to form a monofilament and thereafter drawing the monofilament to a ratio of from about 3.5:1 to 6.0:1. The filament can be employed for the manufacture of fabric.

29 Claims, No Drawings

MONOFILAMENTS, AND FABRICS THEREOF

TECHNICAL FIELD

The present invention is directed toward a blend of two resins forming a novel monofilament, one resin being polyphenylene sulfide. A process for the single step extrusion of such monofilament is also provided. Industrial fabrics manufactured from these monofilaments have utility, particularly as belts on paper forming machines, and are also provided.

Polyphenylene sulfide (PPS) monofilament has been prepared using standard extrusion techniques. It has outstanding chemical and thermal resistance and thus has many potential applications as an industrial filament. In particular PPS has potential for making fabrics for use with paper forming machines. Because of the harsh chemical and thermal environment in which these fabrics are used, fabrics of PPS have extended life and better overall performance than fabrics composed of conventional materials.

BACKGROUND OF THE INVENTION

Due to the high level of crystallinity of PPS, monofilaments thereof tend to be brittle and are difficult to work with. In particular, the knot strength and loop strength of PPS monofilament are low and result in problems during the processing of the monofilaments, especially when the monofilament is woven into fabrics. When the monofilament is removed from the quill during weaving, twists and loops form which, when tightened, kink and result in filament breaks.

Mixtures of PPS with various thermoplastic materials have been prepared heretofore, in an effort to reduce the brittleness. In general, the mixtures are not directly extrudable and have not provided the improvement desired.

In U.S. Pat. No. 4,421,588, PPS is blended with polyetheretherketone using diphenylsulphone as a mutual solvent. The resulting mixture, used for bearing material, has high fatigue strength and improved thermal stability but can be formed only by molding.

In U.S. Pat. No. 4,455,410, PPS is mixed with a polyetherimide for the purpose of obtaining a material with good flexural strength and better mechanical properties than PPS alone. The PPS used in the example was Ryton P-4, a powder grade resin, available from Phillips Chemical Co. and which is suitable for molding rather than extruding. The final products described in the patent were produced by extruding a mixture of the components and then molding the mixtures, i.e., a two step process.

In U.S. Pat. No. 4,493,917, PPS (Ryton P-4, molding grade material) is mixed with fluoropolymers in order to improve the properties of the fluoropolymer which in turn is reflected in a modification of the mechanical properties of the components of electrochemical reactors that are made from fluoropolymers, viz., to reduce the high temperature creep and reduce the high thermal coefficient of expansion of the fluoropolymers. The fluoropolymers specified were fully fluorinated homopolymers or perfluoroalkoxy resins. The process of preparing the components required two steps: preparing the blend by extrusion and then producing the final object by molding.

Thus, it will be seen that the present invention has addressed and solved the problem of polyphenylene sulfide monofilament brittleness. Also the extrudability of this monofilament has been improved by the process of the invention. Neither brittleness nor extrudability has been satisfactorily addressed by the art discussed herein.

DISCLOSURE OF THE INVENTION

The present invention is directed toward a blend of two resins forming a novel monofilament that comprises from about 50 to 95 parts by weight of a linear polyphenylene sulfide and, from about 5 to 50 parts by weight of a melt extrudable copolymer consisting essentially of an olefin and a halogenated monomer.

The process of the present invention includes the steps of extruding a mixture of from about 50 to 95 parts by weight of a linear polyphenylene sulfide and from about 5 to 50 parts by weight of a melt extrudable copolymer consisting essentially of an olefin and a halogenated monomer to form a monofilament and thereafter drawing the monofilament to a ratio of from about 3.5:1 to 6.0:1.

Lastly, a novel fabric is set forth at least partially containing a monofilament formed by a blend of two resins comprising from about 50 to 95 parts by weight of a linear, melt extrudable polyphenylene sulfide and from about 5 to 50 parts by weight of a melt extrudable copolymer consisting essentially of an olefin and a halogenated monomer.

PREFERRED EMBODIMENT FOR CARRYING OUT THE INVENTION

Previous efforts in the art to produce PPS monofilaments having improved brittleness properties have centered on preparing blends of PPS with various thermoplastic resins. While such blends have resulted in reduced monofilament brittleness, i.e., better loop and knot strength, other properties such as tensile strength and abrasion resistance were degraded.

According to the present invention, monofilament prepared from a blend of PPS and a copolymer consisting essentially of an olefin and a halogenated monomer, such as ethylene-tetrafluoroethylene, has reduced brittleness, in terms of higher knot and loop strength, as well as better abrasion resistance. These improvements are made with no significant decrease in the tensile strength of the monofilament. The results are unexpected considering that in all other blends of PPS with various thermoplastics, the corresponding monofilaments have exhibited greatly reduced levels of tensile strength and abrasion resistance.

The PPS material utilized in the monofilament of the present invention must be melt extrudable and thus will have a melt index of from about 100 to about 300 and preferably from about 150 to about 200. One particularly suitable PPS material is commercially available as Ryton GRO2 in pellet form from Phillips Chemical Co., Ryton being a registered trademark.

The second resin forming the monofilament comprises a melt extrudable copolymer which consists essentially of an olefin and a halogenated monomer. The halogenated monomer comprises from about 50 to 90 parts by weight of the copolymer. The olefins include hydrocarbons such as ethylene, propylene, butylene and the like and comprise the remainder of the copolymer, or from about 10 to 50 parts by weight.

Suitable examples of the halogenated monomers are well known to those skilled in the art and include monomers with fluorine functionality with and without chlorine functionality such as tetrafluoroethylene, fluorinated ethylene-propylene, chlorotrifluoroethylene, vinylidene fluoride, hexafluoropropylene and the like. It is to be understood that practice of the present invention is not dependent upon the selection of a particular halogenated monomer and therefore should not be so limited. Also, as a convenience, the term halogenated monomer has been employed in a rather limited sense herein to refer to monomers which, in turn, are understood to include chlorine as well as fluorine.

As noted hereinabove, the term melt extrudable copolymer encompasses copolymers of olefins and halogenated monomers to the exclusion of other known halogenated monomers such as vinyl chloride, vinyl fluoride, trifluorostyrene, and the like which normally are not copolymerized with the olefins. One particularly suitable melt extrudable copolymer is polyethylene-tetrafluoroethylene, or ETFE fluoropolymer, marketed by duPont under the trademark Tefzel and which was employed in the work reported hereinbelow.

With respect to the extrusion process, the monofilament is produced by extruding the two resins together. The two resins, which have been mechanically mixed, are loaded into the extruder hopper and from there fed into a single screw extruder. The melting and intimate blending of the resin mixture takes place in the extruder at a temperature of about 270° C. as the screw conveys the resin mixture forward. The molten and thoroughly blended resin is fed into a metering pump which forces the molten resin through a die to form molten filaments. More particularly, the extrusion temperature ranges between about 285° to 325° C. with 294° to 310° C. being preferred.

The monofilament is quenched in air or a waterbath so that solid filaments are formed. The solid filaments are drawn at room or elevated temperatures up to about 100° C. between a set of draw rolls to a ratio of from about 3.5:1 to 6.0:1 and the drawn filaments are allowed to relax about 2% by passing them through the relaxing stage. The finished filaments are then wound onto spools. Unlike existing processes, which require the blend to be formed first and thereafter chopped, melted and extruded or otherwise molded, the process of the present invention goes from the resin mixture directly to the monofilament.

In order to produce a quality monofilament, it is necessary that the blend of resins after extrusion be homogeneous. In contrast to the blend described in U.S. Pat. No. 4,493,917, whereby the extrusion produced a network of interconnected and interpenetrating fibers of filler within the matrix, the blend of resins in the present invention is uniform and homogeneous. Such a uniform blend is necessary in order to produce monofilaments with uniform properties and uniform diameters.

A monofilament described by the present invention was produced according to the foregoing process and has been set forth hereinbelow as Example No. 1.

EXAMPLE NO. 1

A monofilament blend was produced by mixing and extruding in a single step polyphenylene sulfide (Ryton GRO2) pellets and ethylene-tetrafluoroethylene copolymer (Tefzel 210) pellets in a 6.3 cm single screw extruder. A uniform mixture of the two resins (70% Ryton, 30% Tefzel) was placed in the extruder hopper and extruded in a normal fashion. The extrusion conditions, which are not to be considered limiting, were as follows:

| | |
|---|---|
| First heater zone | 299° C. |
| Second heater zone | 305° C. |
| Third heater zone | 310° C. |
| Fourth heater zone | 310° C. |
| Fifth heater zone | 299° C. |
| Extruder neck | 294° C. |
| Extruder head | 294° C. |
| Extruder die | 294° C. |

The extruder die had ten 1.397 mm holes. The extruder output was 7.66 kilograms per hour and the final monofilament size was 15.7 mils. The monofilament was quenched in a waterbath at a temperature of 66° C. and was 7.62 cm below the extruder die. The quenched monofilament was drawn in a hot air oven at a temperature of about 100° C. with a draw ratio of 4.18 and then allowed to relax 1.6 percent at a temperature of 127° C. The finished monofilament was placed on spools for testing.

For comparative purposes, polyphenylene sulfide (Ryton GRO2) was extruded into monofilament as Example No. 2 using the conditions outlined hereinabove. The two materials, Examples No. 1 and 2, were tested to evaluate their physical properties. The results of the testing are presented in Table I.

TABLE I

Monofilament vs. Monofilament Blend Properties

| Property | Example No. 2 Ryton | Example No. 1 Ryton/Tefzel (70/30) |
|---|---|---|
| Tensile strength[a] | 4.13 kg | 3.86 kg |
| Tensile elongation[a] | 31.06% | 34.9% |
| Knot strength[a] | 2.69 kg | 2.85 kg |
| Knot elongation[a] | 18.98% | 24.9% |
| Loop strength[a] | 2.73 kg | 4.04 kg |
| Loop elongation[a] | 2.4% | 10.0% |
| Abrasion[b] | 28,200 cycles | 60,000 cycles |

[a]Tested according to ASTM method D-885

[b]Squirrel cage abrader, 15 cm diameter, 12 bars made from 316 Stainless Steel, 3.81 mm, 102 rpm

EXAMPLE NOS. 3–5

Polyphenylene sulfide (Ryton GRO2) and polyethylene-tetrafluoroethylene (Tefzel 210) were blended and extruded as described in Example No. 1. The weight proportions were as follows:

| Components | Example No. 3 | Example No. 4 | Example No. 5 |
|---|---|---|---|
| Polyphenylene sulfide | 95 | 90 | 80 |
| Polyethylene-tetrafluoroethylene | 5 | 10 | 20 |

Physical property testing as in Table I provided the results reported shown in Table II.

TABLE II

Monofilament Blend Properties Having Varying Compositions

| Property | Example No. 3 | Example No. 4 | Example No. 5 |
|---|---|---|---|
| Tensile strength[a] | 4.09 kg | 4.09 kg | 4.04 kg |
| Tensile elongation[a] | 32.9% | 35.3% | 34.4% |
| Knot strength[a] | 2.63 kg | 2.68 kg | 2.73 kg |
| Knot elongation[a] | 21.1% | 20.3% | 33.4% |
| Loop strength[a] | 3.02 kg | 2.9 kg | 3.54 kg |
| Loop elongation[a] | 7.0% | 4.0% | 7.8% |

TABLE II-continued

| Property | Monofilament Blend Properties Having Varying Compositions | | |
|---|---|---|---|
| | Example No. 3 | Example No. 4 | Example No. 5 |
| Abrasion[b] | 47,500 | 30,900 | 46,900 |

[a]Tested according to ASTM method D-885
[b]Squirrel cage abrader, 15 cm diameter, 12 bars made from 316 Stainless Steel, 3.81 mm, 102 rpm The monofilament blends described herein could be readily woven into a fabric which would be suitable for industrial purposes such as dryer belts utilized in paper making processes.

The fabric referred to herein is formed by weaving two filament systems, i.e., lengthwise yarn (warp) and crosswise yarn (fill), at least one of which is a monofilament system, in a repeated pattern. Possible patterns include the plain weave in which the filling yarn passes alternately over and under each warp yarn, the twill weave which is formed by interlacing warp and fill so that the filling yarn passes alternately over and under two or more warp yarns, and the satin weave which is formed so that there are more filling yarns on the face than on the inside of the fabric. Variations of these patterns are possible which include combinations of the basic patterns. In addition to these one layer fabrics, fabrics can be woven having two or more layers.

As will be appreciated by those skilled in the art, fabrics can be woven flat and then seamed to form an endless belt or can be woven as an endless belt so that no seam is necessary. It is to be understood that the monofilament of this invention can be used for part or all of the filaments in any of the fabrics described hereinabove.

One suggested use for the fabrics of the present invention is in the paper industry where fabrics were originally made from metal wires. Metal wire fabrics have been largely replaced by fabrics made from synthetic materials such as polyester and nylon because the synthetic materials result in longer life-times for the belts. In some environments, i.e., where high temperatures and corrosive chemicals are present, the ordinary synthetics are not suitable. For this reason materials such as Ryton, which have good chemical and temperature resistance, have been used with success in hostile environments. However, as discussed above, Ryton alone is difficult to work with because it is very brittle. Fabrics prepared from the blends discussed herein have been constructed with no difficulty and have, therefore, substantially eliminated the problems encountered with Ryton.

The known fabrics described hereinabove have been used for the most part on paper forming machines. In these instances, the fabrics are formed into endless belts which are in continuous motion on the paper machine as the paper is formed. It is to be understood that such fabrics also have applications for filter media in situations where the fabric is stationary. The fabrics described in the present invention are prepared from filaments with diameters ranging from 10 mils to 30 mils and have dimensions ranging from 100 to 400 inches wide (254 to 1016 cm) and from 100 to 300 feet long (30.5 to 91.5 m). As indicated above, part of the fabric can comprise the novel monofilament, as warp or fill, or the fabric can be totally manufactured from the novel monofilament (warp and fill). Fabrics of this invention can be utilized on paper forming machines, as filter media and other applications.

In conclusion, it should be clear from the foregoing examples and specification disclosure that the monofilaments of the present invention exhibit improved physical properties as compared to polyphenylene sulfide monofilaments, particularly in the reduction of brittleness without sacrifice of other important properties. The reduction of brittleness is manifested especially by the increase in loop strength of the monofilament of the present invention. Compared to the unblended Ryton monofilament, the monofilament of the present invention exhibits a nearly 50% increase in loop strength. As a practical matter, because of the reduced brittleness, monofilament of the present invention can be readily woven into fabrics without excessive breaking of filaments as is the case of monofilament consisting of unblended Ryton.

It is to be understood that the use of melt extrudable copolymers is not limited to the ETFE fluoropolymer exemplified herein or by the disclosure of typical fluorocarbon polymers provided herein, the examples having been provided merely to demonstrate practice of the subject invention. Those skilled in the art may readily select other melt extrudable copolymers according to the disclosure made hereinabove.

Similarly, practice of the process of the present invention should not be limited to a particular extruder, extrusion temperatures, quench temperature, draw ratio or relaxation ratio from the exemplification it being understood by those skilled in the art that accommodations can be made within the spirit of the invention for differences in equipment as well as in the desired composition and physical properties of the monofilament.

Lastly, it should be appreciated that the monofilaments described herein shall have utility in woven fabric as well as in end-products made therefrom such as paper making belts. Both fabric and related end-products shall have improved physical properties such as temperature and chemical resistance over conventional fabrics composed of nylon and polyester filaments that have been utilized heretofore in similar embodiments.

Thus, it is believed that any of the variables disclosed herein can readily be determined and controlled without departing from the scope of the invention herein disclosed and described. Moreover, the scope of the invention shall include all modifications and variations that fall within the scope of the attached claims.

I claim:

1. A monofilament formed by a blend of two resins comprising:

from about 50 to 95 parts by weight of a linear polyphenylene sulfide; and from about 5 to 50 parts by weight of a melt extrudable copolymer consisting essentially of an olefin and a halogenated monomer.

2. A monofilament, as set forth in claim 1, wherein said olefin comprises from about 10 to 50 parts by weight of said copolymer and said halogenated monomer comprises from about 50 to 90 parts by weight of said copolymer.

3. A monofilament, as set forth in claim 2, wherein said halogenated monomer is selected from the group consisting of fluorinated monomers.

4. A monofilament, as set forth in claim 3, wherein said halogenated monomer contains chlorine.

5. A monofilament, as set forth in claim 3, wherein said melt extrudable copolymer is polyethylene-tetrafluoroethylene.

6. A monofilament, as set forth in claim 5, comprising from about 50 to 95 parts by weight of said polyphenylene sulfide and from about 5 to 50 parts by weight of said copolymer.

7. A monofilament, as set forth in claim 1, having a diameter of from about 10 to 30 mls and a loop strength approximately 50 percent greater than a polyphenylene sulfide monofilament.

8. A fabric at least partially containing a monofilament formed by a blend of two resins comprising:

from about 50 to 95 parts by weight of a linear, melt extrudable polyphenylene sulfide; and from about 5 to 50 parts by weight of a melt extrudable copolymer consisting essentially of an olefin and a halogenated monomer.

9. A fabric, as set forth in claim 8, wherein said olefin comprises from about 10 to 50 parts by weight of said copolymer and said halogenated monomer comprises from about 50 to 90 parts by weight of said copolymer.

10. A fabric, as set forth in claim 9, wherein said halogenated monomer is selected from the group consisting of fluorinated monomers.

11. A fabric, as set forth in claim 10, wherein said fluorinated monomer contains chlorine.

12. A fabric, as set forth in claim 10, wherein said melt extrudable copolymer is polyethylene-tetrafluoroethylene.

13. A fabric, as set forth in claim 12, wherein said monofilament comprises from about 50 to 95 parts by weight of said polyphenylene sulfide and from about 5 to 50 parts by weight of said copolymer.

14. A fabric, as set forth in claim 8, wherein said monofilament has a diameter of from about 10 to 30 mils and a loop strength approximately 50 percent greater than a polyphenylene sulfide monofilament.

15. A fabric, as set forth in claim 8, made entirely of said monofilament.

16. A belt for a paper forming machine comprising the fabric of claim 8.

17. A belt for a paper forming machine comprising the fabric of claim 15.

18. A process for reducing brittleness in polyphenylene sulfide monofilament comprising the steps of:

extruding a mixture of from about 50 to 95 parts by weight of a linear polyphenylene sulfide and from about 5 to 50 parts by weight of a melt extrudable copolymer to form a monofilament; and thereafter drawing said monofilament to a ratio of from about 3.5:1 to 6.0:1.

19. A process, as set forth in claim 18, wherein said step of extruding includes the steps of mixing and melting said resins together in an extruder.

20. A process, as set forth in claim 19, including the further step of mechanically mixing said resins and feeding said mixture to an extruder.

21. A process, as set forth in claim 19, including the further step of quenching said monofilament prior to said step of drawing.

22. A process, as set forth in claim 19, including the further step of relaxing said monofilament approximately two percent following said step of drawing.

23. A process, as set forth in claim 18, wherein said step of extruding is conducted at a temperature of from about 285° to 325° C. and said step of drawing is conducted at a temperature range of from room temperature to about 100° C.

24. A process, as set forth in claim 18, wherein said olefin comprises from about 10 to 50 parts by weight of said copolymer and said halogenated monomer comprises from about 50 to 90 parts by weight of said copolymer.

25. A process, as set forth in claim 24, wherein said halogenated monomer is selected from the group of fluorinated monomers.

26. A process, as set forth in claim 25, wherein said fluorinated monomer contains chlorine.

27. A process, as set forth in claim 25, wherein said melt extrudable copolymer is polyethylene-tetrafluoroethylene.

28. A process, as set forth in claim 27, wherein said monofilament comprises from about 50 to 95 parts by weight of said polyphenylene sulfide and from about 5 to 50 parts by weight of said copolymer.

29. A process, as set forth in claim 18 wherein said monofilament has a diameter of from about 10 to 30 mils and a loop strength approximately 50 percent greater than a polyphenylene sulfide monofilament.

* * * * *

UNITED STATES PATENT AND TRADEMARK OFFICE

CERTIFICATE OF CORRECTION

PATENT NO. : 4,610,916

DATED : September 9, 1986

INVENTOR(S) : Larry Ballard

It is certified that error appears in the above-identified patent and that said Letters Patent is hereby corrected as shown below:

Claim 24, Column 8, line 26, "said" should read --an--; line 28, after the word "and", "said" should read --a--.

Signed and Sealed this

Twenty-fourth Day of October, 1989

*Attest:*

DONALD J. QUIGG

*Attesting Officer*

*Commissioner of Patents and Trademarks*

Disclaimer 4,610,916.—*Larry Ballard*, Columbia, S.C. MONOFILAMENTS, AND FABRICS THEREOF. Patent dated Sept. 9, 1986. Disclaimer filed Feb. 9, 1990, by the assignee, Shakespeare Co.

Hereby enters this disclaimer to claims 18 through 29 of said patent.

[ *Official Gazette April 17, 1990* ]